US006968816B2

(12) United States Patent
Isobe et al.

(10) Patent No.: US 6,968,816 B2
(45) Date of Patent: Nov. 29, 2005

(54) OIL FLOW CONTROL VALVE

(75) Inventors: Eiji Isobe, Kariya (JP); Jiro Kondo, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/964,771

(22) Filed: Oct. 15, 2004

(65) Prior Publication Data

US 2005/0081810 A1 Apr. 21, 2005

(30) Foreign Application Priority Data

Oct. 16, 2003 (JP) ..... 2003-356703

(51) Int. Cl.[7] ..... F01L 1/34

(52) U.S. Cl. ..... 123/90.17; 123/90.12; 123/90.15; 123/90.31; 123/90.33; 251/129.03; 251/129.15; 464/1; 464/2; 464/160; 137/625.11; 137/625.12; 137/625.34; 137/625.35; 137/625.38; 137/625.39

(58) Field of Search ..... 123/90.17, 90.12; 251/129.15; 137/625.34

(56) References Cited

U.S. PATENT DOCUMENTS 6,681,806 B2 * 1/2004 Isobe ..... 137/625.65
6,695,284 B2 * 2/2004 Isobe et al. ..... 251/129.15
2001/0048090 A1 * 12/2001 Kobayashi et al. .... 251/129.15

FOREIGN PATENT DOCUMENTS

JP A-2001-187979 7/2001

* cited by examiner

*Primary Examiner*—Thomas Denion
*Assistant Examiner*—Kyle M. Riddle
(74) *Attorney, Agent, or Firm*—Nixon & Vanderhye P.C.

(57) ABSTRACT

In an oil flow control valve (OCV) according to the present invention, a first volume varying chamber is adapted to communicate with a second volume varying chamber through a second plunger breathing path, and the second volume varying chamber is adapted to communicate with a first breathing hole through an intra-plunger breathing path, an intra-shaft breathing path, and a third volume varying chamber. That is, the breathing path to the second volume varying chamber is long and the volume thereof is large, and the breathing path to the first volume varying chamber is still longer and larger in its volume. Consequently, the amount of foreign matters getting into the first and second volume varying chambers can be decreased and therefore it is possible to prevent the occurrence of an operation defect of the OCV.

7 Claims, 5 Drawing Sheets

OIL FLOW CONTROL VALVE

CROSS-REFERENCE TO RELATED APPLICATION

This application is based on Japanese Patent Application No. 2003-356703 filed on Oct. 16, 2003, the disclosure of which is incorporated herein by reference.

FIELD OF THE INVENTION

The present invention relates to an oil flow control valve (hereinafter referred to as "OCV") in which the flow of oil is switched from one to another by operation of an electromagnetic actuator. Particularly, the present invention is concerned with a technique suitable for use, for example, in a valve variable timing device ("VVT" hereinafter) in which an advance phase of a camshaft can be varied by an oil pressure.

BACKGROUND OF THE INVENTION

According to an OCV disclosed in JP-2001-187979A, a spool of a spool valve is displaced axially by means of an electromagnetic actuator to effect switching of input/output ports formed in a sleeve.

The electromagnetic actuator is provided with a first volume varying chamber on a stator (a member for attracting a plunger magnetically) of a plunger and is also provided with a second volume varying chamber on an opposite side of the first volume varying chamber of the plunger.

On the other hand, the spool valve is provided with a third volume varying chamber on the electromagnetic actuator side of the spool and is also provided with a fourth volume varying chamber on an opposite side of the third volume varying chamber of the spool.

The plunger and the spool are adapted to displace axially integrally. Such axial displacement of the plunger and the spool causes a change in volume of the first to fourth volume varying chambers. One or multiple breathing holes communicating with an external oil path are formed in the sleeve. The breathing hole(s) and the first to fourth volume varying chambers are in communication with each other through a breathing passage. With the breathing hole and the breathing passage, oil can be supplied to the first to fourth volume varying chambers, whereby the plunger and the spool can move axially.

As described above, upon movement of the plunger and the spool, oil is supplied or discharged to the first to fourth volume varying chambers through the breathing hole and the breathing passage.

As a result, foreign matters (wear dust, etc.) contained in the oil are carried into the first to fourth volume varying chambers together with the oil.

The first and second volume varying chambers are formed in the interior of the electromagnetic actuator, and when magnetic foreign matters (e.g., iron powder and iron pieces) get into the both chambers, they may constitute a part of a magnetic circuit. Once this occurs, the magnetism acting on the plunger loses balance and a force acts on the plunger in a direction perpendicular to the axis of the plunger. As a result, the plunger slides strongly against a member (e.g., a cup guide for oil seal) located around the plunger and its movement in its axial direction is obstructed, with a consequent likelihood that characteristics required of OCV may become unable to obtain.

Even a foreign matter which is not a magnetic foreign matter may be deposited in the first and second volume varying chambers and obstruct the movement of the plunger, with a consequent likelihood of OCV becoming inoperative.

SUMMARY OF THE INVENTION

The present invention has been accomplished in view of the above-mentioned problems and it is an object of the invention to provide an OCV capable of diminishing the amount of foreign matters entering the first and second volume varying chambers (both-side chambers formed axially of the plunger) formed in the interior of an electromagnetic actuator or capable of preventing the entry of foreign matters into those chambers.

The OCV according to the present invention includes an electromagnetic actuator which has a coil, a plunger, and a stator, a spool valve having a sleeve and a spool, a shaft for interlocking the plunger and the spool with each other, and an urging means for urging the plunger and the spool to one side (a side different from a magnetically attracting direction of the plunger).

The electromagnetic actuator includes first and second volume varying chambers on both axial ends of the plunger. The spool valve includes third and fourth volume varying chambers on both axial ends of the spool. The sleeve includes a breathing hole communicating with an external oil path.

The first and second volume varying chambers extend through at least the interior of the shaft and the interior of the plunger to communicate with the breathing hole.

DETAILED DESCRIPTION OF EMBODIMENTS

[First Embodiment]

Figure 1:
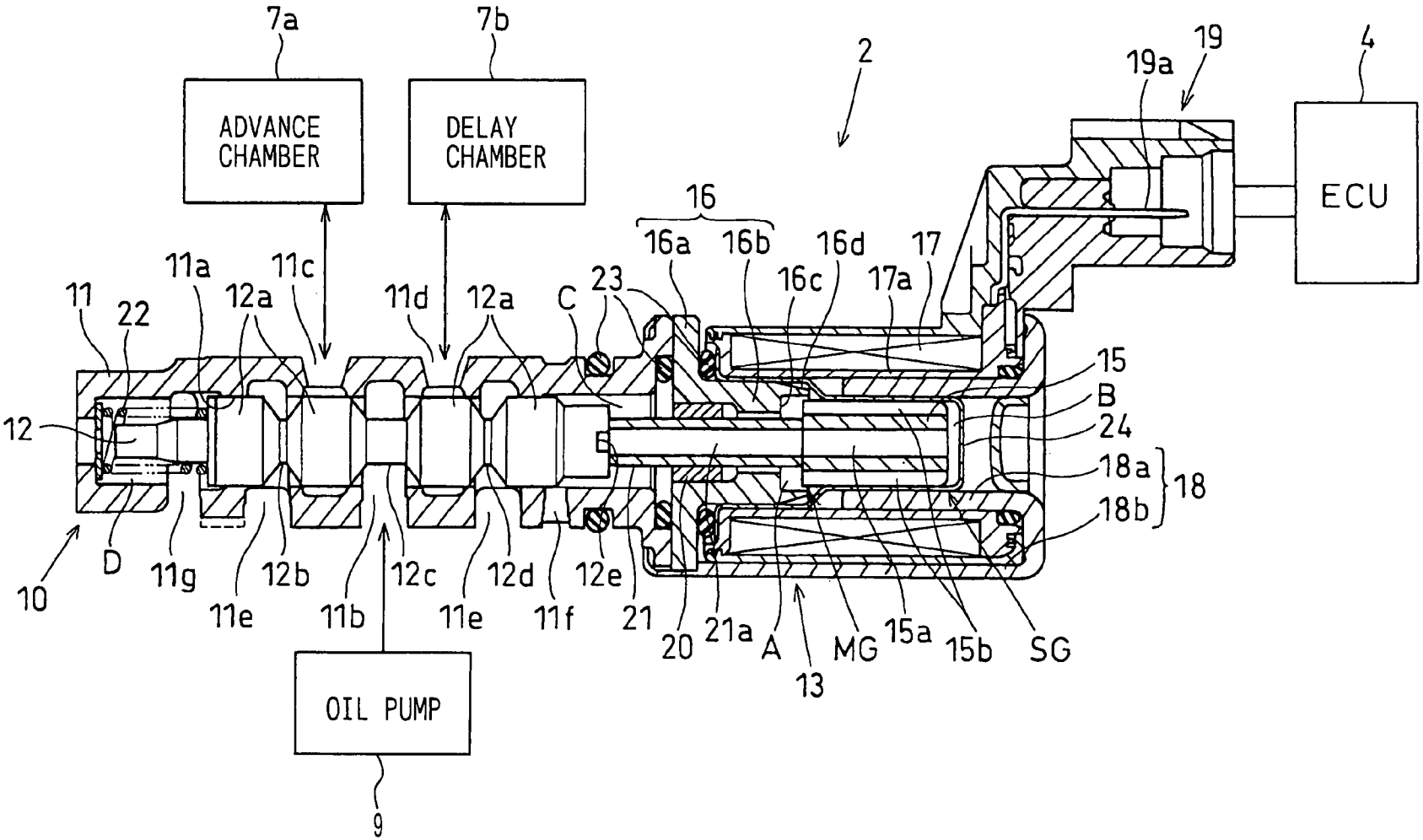
FIG. 1 is an axial sectional view of an OCV.

A first embodiment of the present invention will be described in detail hereinunder with reference to FIGS. 1 to 3. FIG. 1 is a sectional view of an OCV and FIG. 3 is a schematic diagram of a VVT with the OCV applied thereto.

First, a description will be given of the VVT with reference to FIG. 3.

The VTT used in the first embodiment is mounted on a camshaft (any one of a camshaft for intake valves, a camshaft for exhaust valves, and a camshaft for both intake and exhaust valves) in an internal combustion engine (hereinafter referred to simply as "engine") and makes the valve opening/closing time variable continuously.

The VVT is made up of a VCT 1, a hydraulic circuit 3 having an OCV 2, and an ECU (Engine Control Unit) 4 for controlling the OCV 2.

The VCT 1 includes a shoe housing 5 (corresponding to a rotary driven member) which is rotated in synchronization with a crank shaft of the engine and a vane rotor 6 (corresponding to a rotary driven member) which is provided relatively rotatably with respect to the shoe housing 5 and which is adapted to rotate integrally with the cam shaft. The vane rotor 6 is relatively rotated with respect to the shoe housing 5 by means of a hydraulic actuator which is constructed within the shoe housing 5, thereby causing the camshaft to change to either an advance side or a delay side.

The shoe housing 5 is connected with bolts or the like to a sprocket which is mounted on the engine crank shaft and which is rotated through a timing belt or a timing chain. Thus, the shoe housing 5 rotates integrally with the sprocket. As shown in FIG. 3, a plurality (three in this first embodiment) of generally sectorial concave portions 7 are formed in the interior of the shoe housing 5. The shoe housing 5 rotates in the clockwise direction in FIG. 3 and this rotational direction is an advance direction.

On the other hand, the vane rotor 6 is positioned at an end portion of the camshaft with use of a positioning pin or the like and is fixed to the cam shaft end portion with use of bolts or the like. Thus, the vane rotor 6 rotates integrally with the camshaft.

The vane rotor 6 is provided with vanes 6*a*. Each vane 6*a* partitions the interior of the associated concave portion 7 into an advance chamber 7*a* and a delay chamber 7*b*. The vane rotor 6 is disposed to be rotatable within a predetermined angular range relative to the shoe housing 5.

The advance chamber 7*a* is an oil chamber for actuating the vanes 6*a* hydraulically toward the advance side and is formed within the associated concave portion 7 on the side opposite to the rotational direction of the vane 6*a*. Conversely, the delay chamber 7*b* is an oil chamber for actuating the vane 6*a* to the delay side hydraulically. The chambers 7*a* and 7*b* are kept liquid-tight by a sealing member 8 or the like.

The hydraulic circuit 3 is means for supplying oil to the advance chambers 7*a* and the delay chambers 7*b*, causing a difference in oil pressure between each advance chamber 7*a* and the associated delay chamber 7*b* and thereby causing the vane rotor 6 to rotate relatively with respect to the shoe housing 5. The hydraulic circuit 3 includes an oil pump 9 which is actuated by the crankshaft and the OCV 2 which supplies oil fed under pressure by the oil pump 9 into the advance chambers 7*a* and the delay chambers 7*b* selectively.

The OCV 2 will be described below with reference to FIGS. 1 and 2.

The OCV 2 includes a spool valve 10 comprising a sleeve 11 and a spool 12, and an electromagnetic actuator 13 for actuating the spool 12 axially.

The sleeve 11 is formed in a generally cylindrical shape and with plural input/output ports being formed therein. More specifically, an insertion bore 11*a* for supporting the spool 12 axially slidably, an oil pressure supply port 11*b* communicating with an oil discharge port of the oil pump 9, an advance chamber communicating port 11*c* communicating with the advance chamber 7*a*, a delay chamber communicating port 11*d* communicating with the delay chamber 7*b*, and a drain port 11*e* for returning oil into an oil pan 9*a*, are formed in the sleeve 11 used in this first embodiment.

The oil pressure supply port 11*b*, the advance chamber communicating port 11*c*, and the delay chamber communicating port 11*d*, are holes formed in a side face of the sleeve 11. The drain port 11*e*, the advance chamber communicating port 11*c*, the oil pressure supply port 11*b*, the delay chamber communicating port 11*d*, and the drain port 11*e*, are formed from the left side (opposite to the coil) toward the right side (coil side).

The spool 12 has four large-diameter portions 12*a* (lands) as port shut-off portions each having a diameter which is substantially equal to the inside diameter of the sleeve 11 (the diameter of the insertion bore 11*a*).

Between adjacent large-diameter portions 12*a* there are formed a small-diameter portion 12*b* for drain of the advance chamber which small-diameter portion is adapted to change the state of communication of the plural input/output ports (11*b* to 11*e*) in accordance with an axial position of the spool 12, a small-diameter portion 12*c* for the supply of oil pressure, and a small-diameter portion 12*d* for drain of the delay chamber.

The small-diameter portion 12*b* for drain of the advance chamber is for drain of the oil pressure from the advance chamber 7*a* while the oil pressure is supplied to the delay chamber 7*b*. The small-diameter portion 12*c* for the supply of oil pressure is for the supply of oil pressure to one of the advance chamber 7*a* and the delay chamber 7*b*. The small-diameter portion 12*d* for drain of the delay chamber is for draining the oil pressure from the delay chamber 7*b* while the oil pressure is supplied to the advance chamber 7*a*.

The electromagnetic actuator 13 includes a plunger 15, a stator 16, a coil 17, a yoke 18, and a connector 19.

The plunger 15 is formed of a magnetic metal (e.g., iron: a ferromagnetic material constituting a magnetic circuit) which is attracted magnetically by the stator 16. The plunger 15 is supported axially slidably at a position inside the stator 16 (more particularly, inside a cup guide 24 for oil seal).

The stator 16 is formed of a magnetic metal (e.g., iron: a ferromagnetic material constituting a magnetic circuit) and comprises a disc portion 16*a* sandwiched between the sleeve 11 and the coil 17 and a cylindrical portion 16*b* which conducts a magnetic flux of the disc portion 16*a* up to near the plunger 15. A main gap MG (a magnetically attracting gap) is formed between the plunger 15 and the cylindrical portion 16*b*.

A concave portion 16*c*, into which an end portion of the plunger 15 is inserted without contact, is formed in an end of the cylindrical portion 16*b*. The concave portion 16*c* is formed so that, when the plunger 15 enters the interior of the concave portion 16*c* and is attracted to an end portion of the stator 16, the plunger 15 and the stator 16 cross each other partially and axially. The end of the cylindrical portion 16*b* is tapered at 16*d* so that the magnetic attraction does not change relative to a stroke quantity of the plunger 15.

The coil 17 is a magnetism generating means which when energized generates a magnetic force to attract the plunger 15 to the stator 16 magnetically. The coil 17 comprises a large number of enamel wires wound round a resinous bobbin 17*a*.

The yoke 18 is formed of a magnetic metal (e.g., iron: a ferromagnetic material constituting a magnetic circuit) and comprises an inner cylinder portion 18*a* which covers the plunger 15 from around the plunger and an outer cylinder portion 18*b* which surrounds the coil 17 from around the coil. By caulking a pawl portion formed on the right side in FIG. 1, the yoke 18 is connected to the sleeve 11. The inner cylinder portion 18*a* gives and receives a magnetic flux to and from the plunger 15. A side gap SG (a magnetic flux delivery gap) is formed between the plunger 15 and the inner cylinder portion 18*a*.

The connector 19 is a connecting means for making an electric connection to the ECU 4 through a connecting line. The connector 19 has terminals 19*a* connected respectively to both ends of the coil 17.

The OCV 2 includes a shaft 21 which transmits a leftward movement in FIG. 1 of the plunger 15 to the spool 12 and also transmits a rightward movement in FIG. 1 of the spool 12 to the plunger 15, and further includes a spring 22 (urging means) for urging the spool 12 and the plunger 15 in a direction (rightward in FIG. 1) in which the opposed distance between the plunger 15 and the stator 16 becomes longer.

The shaft 21 is supported movably in the axial direction thereof by an inner periphery surface of a cylindrical collar 20 which is disposed inside the disc portion 16*a* of the stator 16. One end of the shaft 21 is in abutment against the spool 12, while an opposite end thereof is in abutment against the plunger 15.

Although in this first embodiment there is shown an example in which the shaft 21 and the spool 12 are abutted against each other, both may be fixed together by press-fitting or the like. Likewise, although there also is shown an example in which the shaft 21 and the plunger 15 are abutted against each other, both may be fixed together by press-fitting or the like. Of course, the shaft 21 may be fixed to both spool 12 and plunger 15.

Although in the illustrated example the spring 22 is disposed at an end of the coil on the side opposite to the coil (left side in FIG. 1) to urge the spool 12 rightward in FIG. 1, the spring 22 may be disposed in another position insofar as the spool 12 and the plunger 15 are fixed to the shaft 21. For example, the spring 22 may be disposed between the stator 16 and the plunger 15 to urge the plunger 15 rightward in FIG. 1.

In the OCV 2, when the coil 17 turns OFF, the spool 12 and the plunger 15 are displaced toward the coil (rightward in FIG. 1) with the biasing force of the spring 22 and stops.

In this standstill state, a maximum gap of the main gap MG is determined and the positioning of the spool 12 relative to the sleeve 11 is performed.

The reference numeral 23 shown in FIG. 1 denotes an O-ring for sealing.

The shaft 21 is formed integrally with the spool 12 or the plunger 15.

The ECU 4 makes a duty ratio control to control the amount of an electric current ("supply current quantity" hereinafter) to be supplied to the coil 17 in the electromagnetic actuator 13. By controlling the supply current quantity for the coil 17, an axial position of the spool 12 is controlled linearly and a hydraulic pressure corresponding to an operating condition of the engine is produced in the advance chambers 7*a* and the delay chambers 7*b* to control an advance position of the camshaft.

For advancing the camshaft in accordance with an operating condition of the vehicle, the ECU 4 increases the supply current quantity for the coil 17. With the increase of the supply current quantity, the magnetic force which the coil 17 generates increases and both plunger 15 and spool 12 move to the side opposite to the coil (leftward in FIG. 1: advance side). Consequently, a communication ratio between the oil pressure supply port 11*b* and the advance chamber communicating port 11*c* increases and so does the communication ratio between the delay chamber communicating port 11*d* and the drain port 11*e*. As a result, the oil pressure in the advance chamber 7*a* increases, while the oil pressure in the delay chamber 7*b* decreases, so that the vane rotor 6 displaces relatively to the advance side with respect to the shoe housing 5 and the camshaft advances.

Conversely, for delaying the camshaft in accordance with an operating condition of the vehicle, the ECU 4 decreases the supply current quantity for the coil 17. With the decrease of the supply current quantity, the magnetic force which the coil 17 generates decreases and both plunger 15 and spool 12 move toward the coil (rightward in FIG. 1: delay side). Consequently, a communication ratio between the oil pressure supply port 11*b* and the delay chamber communicating port 11*d* increases and so does the communication ratio between the advance chamber communicating port 11*c* and the drain port 11*e*. As a result, the oil pressure in the delay chamber 7*b* increases, while the oil pressure in the advance chamber 7*a* decreases, so that the vane rotor 6 displaces relatively to the delay side with respect to the shoe housing 5 and the camshaft 5 delays.

As the plunger 15 moves axially in the interior of the electromagnetic actuator 13, volume varying chambers adapted to vary in volume with movement of the plunger 15 are formed on both axial sides of the plunger.

The volume varying chamber formed on the stator side (left side in FIG. 1) of the plunger 15 is designated as first volume varying chamber A, while the volume varying chamber formed on the side opposite to the stator (a different side from the first volume varying chamber A: right side in FIG. 1) of the plunger 15 is designated as second volume varying chamber B.

On the other hand, since the spool 12 also moves axially in the interior of the sleeve 11, volume varying chambers adapted to vary in volume with movement of the spool 12 are formed on both axial sides of the sleeve 11.

The volume varying chamber formed on the electromagnetic actuator side (right side in FIG. 1) of the spool 12 is designated as third volume varying chamber C and the volume varying chamber formed on the side (left side in FIG. 1) opposite to the electromagnetic actuator of the spool 12 is designated as a fourth volume varying chamber D.

A first breathing hole 11*f* communicating with the third volume varying chamber C and a second breathing hole 11*g* communicating with the fourth volume varying chamber D are formed in the sleeve 11.

The first and second breathing holes 11*f*, 11*g* are oil paths communicating with an external oil path (an oil path communicating with the drain port 11*e*) which returns the oil to the oil pan 9*a*. When the spool 12 displaces axially, the oil in the third and fourth volume varying chambers C, D is discharged from the first and second breathing holes 11*f*, 11*g*.

The first and second volume varying chambers A, B are formed so as to communicate with the first breathing hole 11*f* at least through, in series, an intra-shaft breathing path 21*a* formed in the interior of the shaft 21 and an intra-plunger breathing path 15*a* formed in the interior of the plunger 15. Clearances formed inside and outside the collar 20 are formed small lest the first and third volume varying chambers A, C should positively communicate with each other through the collar 20.

In this first embodiment, the second volume varying chamber B formed within the electromagnetic actuator 13 communicates with the third volume varying chamber C through the intra-plunger breathing path 15*a* formed centrally of the plunger 15 and further through the intra-shaft breathing path 21*a* formed centrally of the shaft 21. The oil present in the second volume varying chamber B is discharged through the intra-plunger breathing path 15*a*, the intra-shaft breathing path 21*a*, the third volume varying chamber C, and the first breathing hole 11*f*.

Figure 2A:
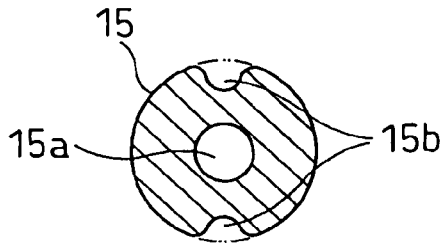
FIGS. 2A and 2B are sectional views of a plunger in a direction orthogonal to an axial direction of the plunger.
Figure 3:
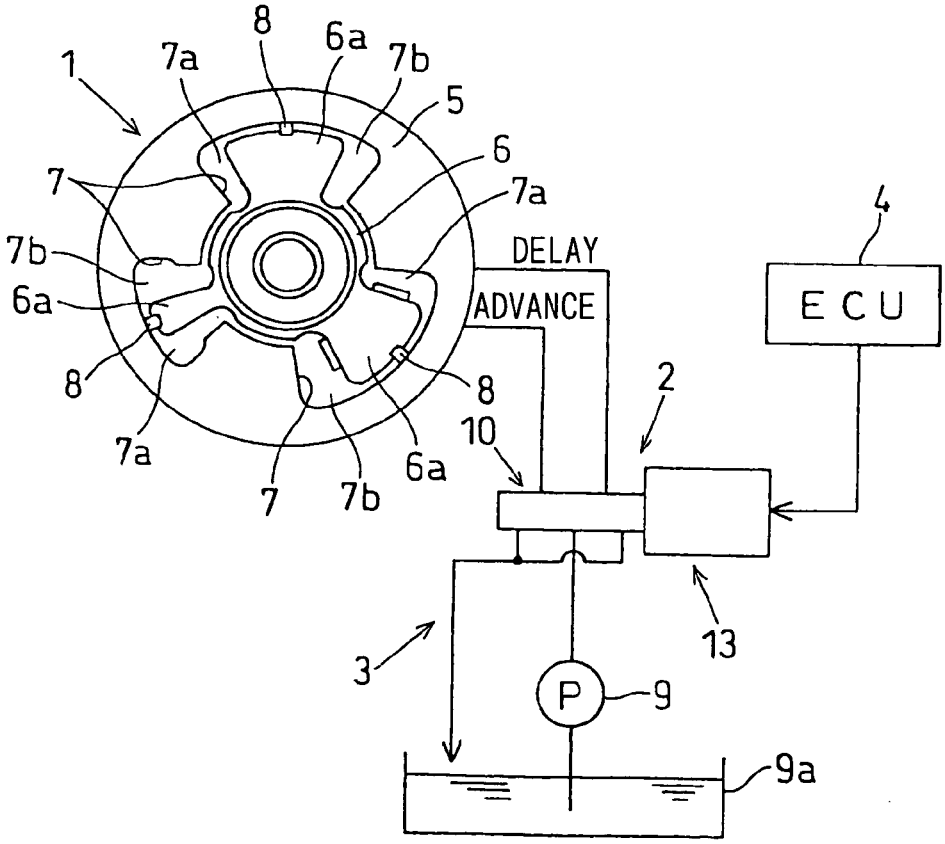
FIG. 3 is a schematic diagram of a VVT.

On the other hand, the first volume varying chamber A in the electromagnetic actuator 13 communicates with the second volume varying chamber B through second plunger breathing paths 15*b* which are formed like grooves in the outer periphery of the plunger 15, as shown in FIG. 2A. The oil present in the first volume varying chamber A is discharged through the second plunger breathing path 15*b*, the second volume varying chamber B, the intra-plunger breathing path 15*a*, the intra-shaft breathing path 21*a*, the third volume varying chamber C, and the first breathing path 11*f*.

Thus, the oil present in the second volume varying chamber B is discharged through a long breathing path including the intra-plunger breathing path 15*a*, the intra-shaft breathing path 21*a*, and the third volume varying chamber C. The oil present in the first volume varying chamber A is discharged through a still longer breathing path including the second breathing paths 15*b*, the second volume varying chamber B, the intra-plunger breathing path 15*a*, the intra-shaft breathing path 21*a*, and the third volume varying chamber C.

In this first embodiment, a breathing groove 12*e* is formed in a surface of the spool 12 against which surface the shaft 21 comes into abutment, whereby the third volume varying chamber C and the intra-shaft breathing path 21*a* are brought into communication with each other. However, no limitation is made thereto. For example, a breathing groove may be formed in a surface of the shaft 21 against which surface the spool 12 comes into abutment.

As shown in this first embodiment, since the breathing path for the supply and discharge of oil to and from the interior of the electromagnetic actuator 13 is made long to increase the volume of the same path, foreign matters contained in the oil are difficult to reach the first and second volume varying chambers A, B formed within the electromagnetic actuator 13. It is therefore possible to decrease the amount of foreign matters getting into both volume varying chambers A and B.

Particularly, since the breathing path reaching the first volume varying chamber A is longer than the breathing path reaching the second volume varying chamber B, it is possible to decrease the amount of foreign matters entering the first volume varying chamber A which constitutes the main gap MG.

As a result, it is possible to prevent the occurrence of an operation defect of OCV 2 caused by the entry of foreign matters into the electromagnetic actuator 13 and hence possible to maintain the characteristics required of the OCV 2 over a long period and enhance the reliability of the OCV 2.

[Modifications of First Embodiment]

Although in the above first embodiment two second plunger breathing paths 15*b* are formed in the outer periphery of the plunger 1, the number of the paths 15*b* is not limited to two. One or three or more second plunger breathing paths 15*b* may be provided.

Figure 2B:
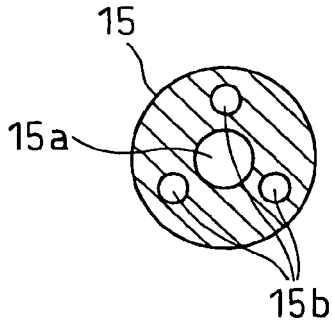

Without forming the second plunger breathing paths 15*b* like grooves in the outer periphery of the plunger 15, second plunger breathing paths 15*b* may be formed axially through the interior of the plunger 15 (outside the intra-plunger breathing path 15*a*), as shown in FIG. 2B. Also in this case, the number of the second plunger breathing paths 15*b* is not limited to three, but may be one or two, or four or more.

Although in the above first embodiment the second volume varying chamber B and the first volume varying chamber A are brought into direct communication with each other through the second plunger breathing path 15*b* as an example of the breathing path which reaches the first volume varying chamber A, a bypath which provides communication between the intra-plunger breathing path 15*a* and the first volume varying chamber A may be provided in the interior of the plunger 15 and oil may be allowed to flow a passage including the intra-plunger breathing path 15*a*, the bypath, and the first volume varying chamber A. That is, a breathing path which short-cuts the second volume varying chamber B may be provided for the supply and discharge of oil to and from the first volume varying chamber A.

[Second Embodiment]

Figure 4:
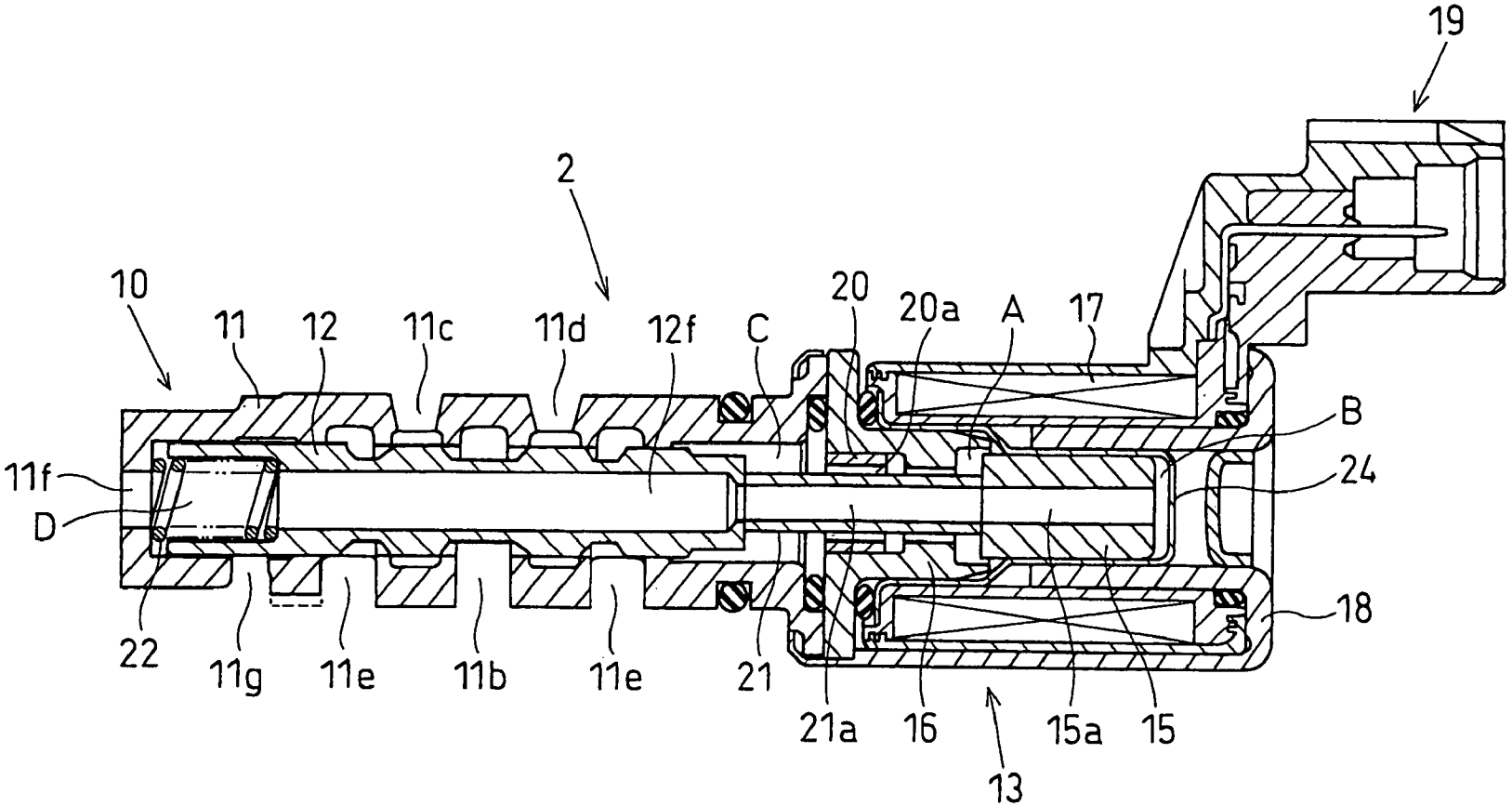
FIG. 4 is an axial sectional view of the OCV.

A second embodiment of the present invention will be described below with reference to FIGS. 4 and 5. The same reference numerals as in the first embodiment represent the same functional components.

In this second embodiment, a first breathing hole 11*f* is formed at an end of a sleeve 11 on the side (left side in FIG. 4) opposite to the electromagnetic actuator. The first breathing hole 11*f* communicates with a second volume varying chamber B through, in series, an intra-spool breathing path 12*f* as a thick and long path formed in the interior of a spool 12, an intra-shaft breathing path 21*a* formed in the interior of a shaft 21, and an intra-plunger breathing path 15*a* formed in the interior of a plunger 15.

Figure 5A:
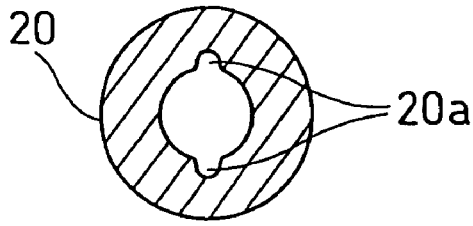
FIGS. 5A, 5B, and 5C are sectional views of a collar in a direction orthogonal to an axial direction of the collar.

On the other hand, as shown in FIG. 5A, first and third volume varying chambers A, C are in communication with each other through groove-like first/third communication paths 20*a* formed in the inner periphery of the collar 20 to effect the supply and discharge of oil with respect to each other. The first and third volume varying chambers A, C are shut off from the exterior.

The outside diameter of the spool 12 and that of the plunger 15 are set equal to each other so that a change in volume of the first volume varying chamber A and that of the third volume varying chamber C become equal to each other when the plunger 15 and the spool 12 move through the shaft 21. That is, even upon movement of both plunger 15 and spool 12, a change in volume of "first volume varying chamber A+third volume varying chamber C" is zero.

Since the plunger 15 and the spool 12 are thus provided, by merely making the first and third volume varying chambers A, C communicate with each other through the first/third communication paths 20*a*, the internal pressure of the first volume varying chamber A and that of the third volume varying chamber C become equal to each other. Thus, it is not necessary to provide a breathing path communicating with the exterior, nor is provided such a breathing path in this second embodiment.

As a result, although oil enters the first and third volume varying chambers A, C through a fine clearance, there is no positive supply and discharge of oil and hence foreign matters do not get into both chambers A and C.

Accordingly, it is possible to prevent the occurrence of an operation defect of the OCV 2 which is caused by the entry of foreign matters into the first volume varying chamber A.

On the other hand, as noted above, the second volume varying chamber B formed in the interior of the electromagnetic actuator 13 is brought into communication with the first breathing hole 11*f* through, in series, the thick and long intra-spool breathing path 12*f*, intra-shaft breathing path 21*a*, and intra-plunger breathing path 15*a*.

Thus, since the breathing path for the supply and discharge of oil to and from the second volume varying chamber B is made long to enlarge the volume thereof, foreign matters contained in the oil are difficult to reach the second volume varying chamber B and therefore it is possible to decrease the amount of foreign matters getting into the second volume varying chamber B.

Consequently, it is possible to prevent the occurrence of an operation defect of the OCV 2 which is caused by the entry of foreign matters into the second volume varying chamber B.

Thus, since the entry of foreign matters into the first and second volume varying chambers A, B defined in the interior of the electromagnetic actuator 13 is prevented, it is possible to prevent the occurrence of an operation defect of the OCV 2 and hence possible to maintain the characteristics required of the OCV 2 over a long period and enhance the reliability of the OCV 2.

[Modifications of Second Embodiment]

Although in the above second embodiment the two first/third communication paths 20*a* are formed like grooves in the inner periphery of the collar 20, as shown in FIG. 5A, there may be provided one or three or more first/third communication path(s) 20*a*.

Figure 5B:
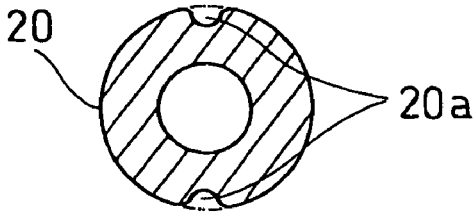

Without forming the first/third communication paths 20*a* in the inner periphery of the collar 20, both communication paths may be formed like grooves in the outer periphery of the collar 20, as shown in FIG. 5B. In this case, the number of the first/third communication paths 20*a* is not limited to two as in FIG. 5B, but may be one or three or more.

Figure 5C:
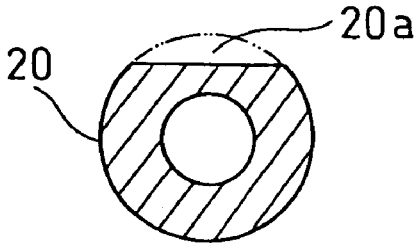

Further, the shape of the first/third communication paths 20*a* is not limited to such groove-like shapes as shown in FIGS. 5A and 5B, but may be such a cut surface (D cut) shape as shown in FIG. 5C. Also in this case, the number is not limited to one, but may be two or more.

[Third Embodiment]

A third embodiment of the present invention will now be described with reference to FIG. 6. The same reference numerals as in the first and second embodiments represent the same functional components.

In the above second embodiment the first and third volume varying chambers A, C are merely brought into communication through the first/third communication paths 20*a* without forming any breathing path communicating with the exterior.

Figure 6:
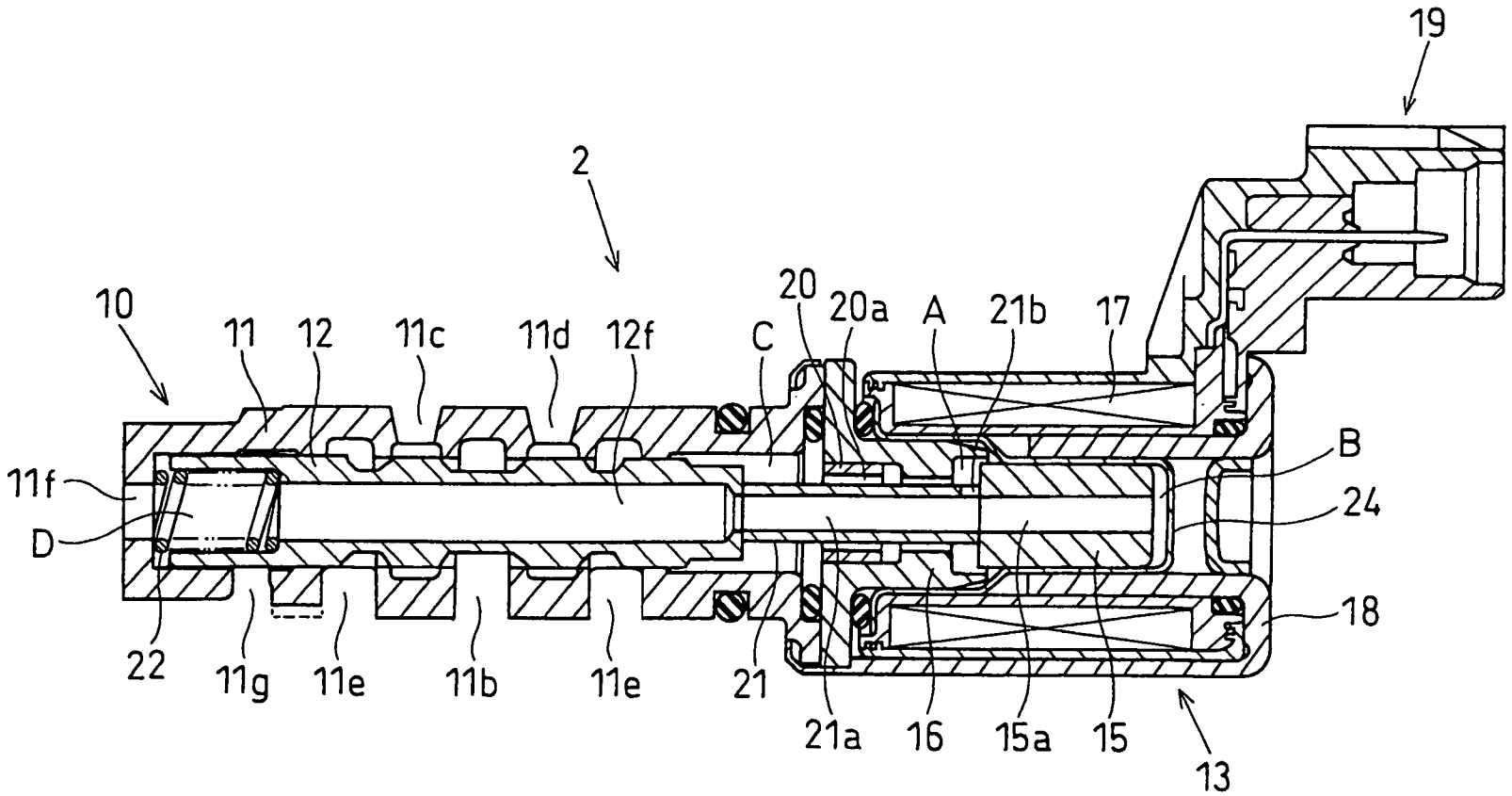
FIG. 6 is an axial sectional view of the OCV.

On the other hand, in this third embodiment, as shown in FIG. 6, a first volume varying chamber A and an intra-plunger breathing path 15*a* are brought into communication with each other through a bypass port 21*b* formed in a plunger-side end of the shaft 21.

According to such a construction of this third embodiment, the first volume varying chamber A formed in the interior of an electromagnetic actuator 13 communicates with a first breathing hole 11*f* through, in series, a thick and long intra-spool breathing path 12*f*, and intra-shaft breathing path 21*a*, so that foreign matters contained in oil are difficult to reach the first volume varying chamber A. Further, even when both plunger 15 and spool 12 move, since the change in volume of the first volume varying chamber A+third volume varying chamber C is zero, the supply or discharge (breathing) of oil through the bypass port 21*b* is scarcely performed and a substantial entry of foreign matters into the first volume varying chamber A is prevented.

On the other hand, a second volume varying chamber B formed in the interior of the electromagnetic actuator 13, as is the case with the second embodiment, communicates with the first breathing hole 11*f* through, in series, the thick and long intra-spool breathing path 12*f*, intra-shaft breathing path 21*a*, and intra-plunger breathing path 15*a*. Accordingly, foreign matters contained in oil are difficult to reach the second volume varying chamber B and hence it is possible to decrease the amount of foreign matters entering the second volume varying chamber B.

Thus, the entry of foreign matters into the first and second volume varying chambers A, B formed in the interior of the electromagnetic actuator 13 is prevented, the occurrence of an operation defect of OCV 2 can be prevented. Consequently, it is possible to maintain the characteristics required of the OCV 2 over a long period and hence possible to enhance the reliability of the OCV 2.

[Modifications of Third Embodiment]

In the above third embodiment the outside diameter of the spool 12 and that of the plunger 15 are set equal to each other so that a change in volume of the first volume varying chamber A and that of the third volume varying chamber C become equal to each other upon movement of both plunger 15 and spool 12. However, a modification may be made such that there slightly occurs a change in volume of the first and third volume varying chambers A, C and breathing are performed slightly in the bypass port 21*b*. Alternatively, there may be adopted a modification such that a change in volume of the first volume varying chamber A and that of the third volume varying chamber C are different and breathing is performed in the bypass port 21*b*.

Although in the above third embodiment the bypass port 21*b* is formed in an end of the shaft 21, a bypass port may be formed like a groove in a surface of the plunger 15 which surface comes into abutment against the shaft 21. Without providing the bypass port 21*b*, the first and second volume varying chambers A, B may be brought into communication with each other through the second plunger breathing path 15*b* shown in the first embodiment.

[Modifications]

The VCT 1 shown in the above embodiments is a mere example for explaining the embodiments and it may be of any other structure insofar as the adjustment of advance can be made by the hydraulic actuator 13 disposed in the interior of the VCT 1.

For example, although in the above embodiments three concave portions 7 are formed in the interior of the shoe housing 5 and three vanes 6*a* are provided in the outer periphery portion of the vane rotor 6, the number of concave portion 7 and that of vane 6*a* are not specially limited in structure insofar as each may be one or more.

Although in the above embodiments the shoe housing 5 rotates in synchronization with the crank shaft and the vane rotor 6 rotates integrally with the cam shaft, there may be adopted a construction such that the vane rotor 6 is rotated in synchronization with the crank shaft and the shoe housing 5 rotates integrally with the cam shaft.

Although the spool 12 used in the above embodiments has the large-diameter portion 12*a* and the small-diameter portions 12*b*–12*d*, the structure of the spool 12 is not specially limited. For example, a cylindrical spool 12 may be used.

Although in the above embodiments input/output ports (the oil pressure supply port 11*b*, advance chamber communicating port 11*c*, and delay chamber communicating port 11*d* in the embodiments) are formed by forming holes in the side face of the sleeve 11, the structure of the sleeve 11 is not specially limited. For example, plural input/output ports may be formed by forming through holes in the diametrical direction of the sleeve 11.

The structure of the electromagnetic actuator 13 described in the above embodiments is a mere example for explaining the embodiments and another structure may be adopted. For example, the plunger 15 may be disposed in the axial direction of the coil 17.

Although in the above embodiments the spool displaces to the opposite-to-coil side upon turning ON of the coil 17, a modification may be made such that the spool 12 displaces to the coil side upon turning ON of the coil 17.

Although in the above embodiments the present invention is applied to the OCV 2 which is combined with the VCT 1, the present invention is applicable to all of OCVs of the type which intermits the flow of oil or switches the flowing direction of oil.

What is claimed is:

1. An oil flow control valve comprising:

a spool valve including a sleeve formed with oil input/output ports and a spool adapted to displace axially in the interior of the sleeve to switch over the input/output ports;

an electromagnetic actuator, the electromagnetic actuator including a coil which when energized generates a magnetic force, a plunger disposed axially movably, and a stator which conducts the magnetic force generated by the coil to an axial position of the plunger opposed to the stator, the plunger being attracted to the stator with the magnetic force generated by the coil;

a shaft which transmits an axial movement of the plunger to the spool, and transmits an axial movement of the spool to the plunger; and an urging means for urging the plunger and the spool in a direction in which an opposed distance between the plunger and the stator becomes longer, the electromagnetic actuator further including a first volume varying chamber formed axially in the plunger on the side opposed to the stator, and a second volume varying chamber formed axially in the plunger on the side different from the first volume varying chamber, the spool valve including a third volume varying chamber formed axially in the spool on the electromagnetic actuator side and a fourth volume varying chamber formed axially in the spool on the side different from the third volume varying chamber, the sleeve including a breathing hole communicating with an external oil path, and the first and second volume varying chambers being brought into communication with the breathing hole at least through both the interior of the shaft and the interior of the plunger.

2. An oil flow control valve according to claim 1, wherein the first and second volume varying chambers communicate with each other through a second plunger breathing path formed in the plunger.

3. An oil flow control valve according to claim 1, further comprising:

a rotary drive member adapted to be rotated in synchronization with a crank shaft of an internal combustion engine; and a rotary driven member disposed relatively rotatably with respect to the rotary drive member and adapted to rotate integrally with a camshaft in the internal combustion engine, and wherein the cam shaft is displaced to an advance side together with the rotary driven member relative to the rotary drive member by supplying an oil pressure to an advance chamber formed between the rotary drive member and the rotary driven member, while the cam shaft is displaced to a delay side together with the rotary driven member relative to the rotary drive member by supplying an oil pressure to a delay chamber formed between the rotary drive member and the rotary driven member, and during operation of the internal combustion engine, an oil pressure generated in an oil pressure source is supplied to the advance chamber and the delay chamber in a relative manner.

4. An oil flow control valve comprising:

a spool valve including a sleeve formed with oil input/output ports and a spool adapted to displace axially in the interior of the sleeve to switch over the input/output ports;

an electromagnetic actuator, the electromagnetic actuator including a coil which when energized generates a magnetic force, a plunger disposed axially movably, and a stator which conducts the magnetic force generated by the coil to an axial position of the plunger opposed to the stator, the plunger being attracted to the stator with the magnetic force generated by the coil;

a shaft which transmits an axial movement of the plunger to the spool and transmits an axial movement of the spool to the plunger; and an urging means for urging the plunger and the spool in a direction in which an opposed distance between the plunger and the stator becomes longer, the electromagnetic actuator further including a first volume varying chamber formed axially in the plunger on the side opposed to the stator, and a second volume varying chamber formed axially in the plunger on the side different from the first volume varying chamber, the spool valve including a third volume varying chamber formed axially in the spool on the electromagnetic actuator side and a fourth volume varying chamber formed axially in the spool on the side different from the third volume varying chamber, the sleeve including a breathing hole communicating with an external oil path, the second volume varying chamber being brought into communication with the breathing hole at least through both the interior of the shaft and the interior of the plunger, wherein a change in volume of the first volume varying chamber and that of the third volume varying chamber become almost equal to each other when the plunger and the spool move through the shaft, and the first and the third volume varying chambers are brought into communication with each other through first/third communication paths.

5. An oil flow control valve according to claim 4, wherein the first and third volume varying chambers and the first/third communication paths are shut off from the oil path communicating with the breathing hole.

6. An oil flow control valve comprising:

a spool valve including a sleeve formed with oil input/output ports and a spool adapted to displace axially in the interior of the sleeve to switch over the input/output ports;

an electromagnetic actuator, the electromagnetic actuator including a coil which when energized generates a magnetic force, a plunger disposed axially movably, and a stator which conducts the magnetic force generated by the coil to an axial position of the plunger opposed to the stator, the plunger being attracted to the stator with the magnetic force generated by the coil;

a shaft which transmits an axial movement of the plunger to the spool and transmits an axial movement of the spool to the plunger; and an urging means for urging the plunger and the spool in a direction in which an opposed distance between the plunger and the stator becomes longer, the electromagnetic actuator further including a first volume varying chamber formed axially in the plunger on the side opposed to the stator; and a second volume varying chamber formed axially in the plunger on the side different from the first volume varying chamber, the spool valve including a third volume varying chamber formed axially in the spool on the electromagnetic actuator side; and a fourth volume varying chamber formed axially in the spool on the side different from the third volume varying chamber, the sleeve including a breathing hole communicating with an external oil path, and the first and second volume varying chambers being brought into communication with the breathing hole at least through both the interior of the spool and the interior of the shaft.

7. An oil flow control valve according to claim 6, wherein a change in volume of the first volume varying chamber and that of the third volume varying chamber become almost equal to each other when the plunger and the spool move through the shaft, and the first and the third volume varying chambers are brought into communication with each other through first/third communication paths.

* * * * *